US008803702B2

(12) United States Patent
Kagoura

(10) Patent No.: US 8,803,702 B2
(45) Date of Patent: Aug. 12, 2014

(54) INSTRUMENT STATUS DISPLAYING DEVICE AND INSTRUMENT STATUS DISPLAYING METHOD

(71) Applicant: AZBIL Corporation, Tokyo (JP)

(72) Inventor: Mamoru Kagoura, Tokyo (JP)

(73) Assignee: Azbil Corporation, Tokyo (JP)

( * ) Notice: Subject to any disclaimer, the term of this patent is extended or adjusted under 35 U.S.C. 154(b) by 63 days.

(21) Appl. No.: 13/686,547

(22) Filed: Nov. 27, 2012

(65) Prior Publication Data

US 2013/0135113 A1 May 30, 2013

(30) Foreign Application Priority Data

Nov. 28, 2011 (JP) ..... 2011-258993

(51) Int. Cl.
*G08B 5/22* (2006.01)

(52) U.S. Cl.
USPC ..... 340/687; 340/686.1

(58) Field of Classification Search
USPC ..... 340/687, 686.1, 691.1, 691.6
See application file for complete search history.

(56) References Cited

U.S. PATENT DOCUMENTS 8,164,474 B2 * 4/2012 James ..... 340/687
2012/0166693 A1 * 6/2012 Weinstock et al. ..... 710/105

FOREIGN PATENT DOCUMENTS

JP 2004-247785 A 9/2004
JP 2005-346444 12/2005
JP 2005-346444 A 12/2005

OTHER PUBLICATIONS

Korean Office Action, dated Dec. 19, 2013, which issued during the prosecution of Korean Patent Application No. 2012-0129455, which corresponds to the present application.

* cited by examiner

*Primary Examiner* — Toan N Pham
(74) *Attorney, Agent, or Firm* — Troutman Sanders LLP

(57) ABSTRACT

An instrument status display displaying on a screen, in a tree format, respective indicators corresponding to instruments controlled in a hierarchical structure, having an installation time mark acquiring portion acquiring, as an applicable installation time mark, a time mark that is nearest to a reference time mark without being later than the reference time mark, where the time mark is a time mark for the connection of an instrument, from an installation/removal event history database; an alert event acquiring portion acquiring alert event information notified from an instrument over the interval from the applicable installation time mark, acquired by the installation time mark acquiring portion, up until the reference time mark; a display formatter determining a display format of an indicator based on alert event information; and a displaying portion displaying, on a screen, an indicator in a display format determined by the display formatter.

8 Claims, 8 Drawing Sheets

FIG. 2

| Installation/Removal Event Information | | |
|---|---|---|
| Installation/Removal Event Time Marks | Installation/Removal Flag | Instrument Identifying Information |
| 2011/10/31 23:30:50 | Removed | A0001 |
| 2011/10/31 23:55:15 | Removed | E0001 |
| 2011/11/01 1:14:30 | Installed | A0001 |
| 2011/11/01 1:32:00 | Installed | E0001 |
| ... | ... | ... |

FIG. 3

| Alert Event Information | | | | | |
|---|---|---|---|---|---|
| Alert Event Time Mark | Alert Notification Time Mark | Alert Category | Priority Level | Acknowledgment Flag | Instrument Identifying Information |
| 2011/10/31 23:50:15 | 2011/11/01 1:15:00 | Fault | 1 | No | B0001 |
| 2011/10/31 23:53:50 | 2011/11/01 1:15:00 | Adjustment in Process | 2 | No | D0001 |
| 2011/11/01 0:10:10 | 2011/11/01 0:10:10 | Normal | 7 | Yes | F0001 |
| 2011/11/01 0:12:30 | 2011/11/01 0:12:30 | Requires Maintenance | 4 | Yes | H0001 |
| ... | ... | ... | ... | ... | ... |

FIG. 4

| Instrument Information | | |
|---|---|---|
| Instrument Identifying Information | Hierarchical Information | |
| | Parent Identifying Information | Child Identifying Information |
| A0001 | — | B0001, C0001, D0001 |
| B0001 | A0001 | — |
| C0001 | A0001 | — |
| D0001 | A0001 | — |
| ... | ... | ... |

FIG. 5
(A)
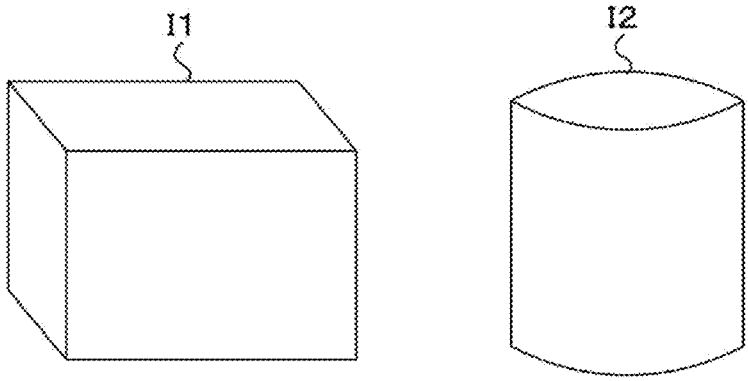
(B)
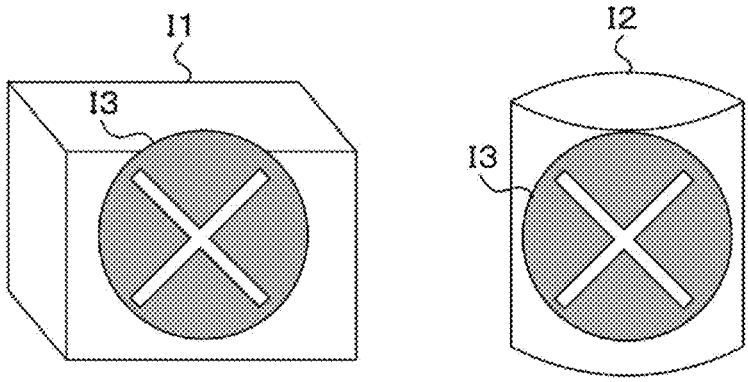

FIG. 6

| Priority | Icon |
|---|---|
| 1 | |
| 2 | |
| 3 | ? |
| 4 | |
| 5 | i |
| 6 | ! |
| 7 | |

INSTRUMENT STATUS DISPLAYING DEVICE AND INSTRUMENT STATUS DISPLAYING METHOD

CROSS-REFERENCE TO RELATED APPLICATION

This application claims priority to Japanese Patent Application No. 2011-258993 filed Nov. 28, 2011. The Japanese priority document is incorporated herein by reference in its entirety.

FIELD OF TECHNOLOGY

The present invention relates to an instrument status displaying device and an instrument status displaying method.

BACKGROUND

In a work area wherein production processes are controlled, large numbers of instruments (for example, sensor instruments and devices such as valve positioners) are located throughout the plant in order to control the processes. The various instruments within the plant are typically connected in a hierarchical structure. Consequently, in a system for controlling instruments the instruments are displayed in a control screen in a tree format matching that hierarchical structure, to enable the large number of instruments, which exist in a complex arrangement, to be understood easily. Japanese Unexamined Patent Application Publication 2005-346444 ("JP '444") discloses a control system for displaying, using icons, alert statuses that are produced by the individual instruments, with the instruments displayed in a tree format.

However, for example, in performing maintenance or inspections on the individual instruments, or when replacing the instruments, the instruments are temporarily cut off (disconnected) from the system when the operation is performed. Consequently, when, for example, an instrument that is on a higher hierarchical level is disconnected, the group of instruments that are located hierarchically therebelow are also cut off from the system. However, because the group of instruments located on the lower hierarchical levels continue to operate even when they are cut off, it is possible that alerts may be produced while they are cut off. In the control system of JP '444, above, the alert status at the current point in time is displayed for each of the instrument status connected to the system, but no thought is given to those instruments that are cut off from the system. Consequently, in this control system, it is not possible to ascertain, on the control screen, alert statuses that have been produced in the group of instruments on the lower hierarchical level during the time period in which they are cut off from the system when an instrument on a higher hierarchical level is temporarily disconnected and then connected again thereafter.

The present invention was created in order to solve the problem area set forth above in the conventional technology, and the object thereof is to provide an instrument status displaying device and instrument status displaying method able to display also those statuses of instruments for the period of time over which they were cut off from the system.

SUMMARY

The instrument status displaying device for displaying on a screen, in a tree format, respective indicators corresponding to a plurality of instruments controlled in a hierarchical structure, includes an installation time mark acquiring portion for acquiring, as an applicable installation time mark, from an installation/removal event history storing portion for storing installation/removal event information pertaining to installation/removal of events that occur when an instrument is connected to or disconnected from a system, a time mark for when the instrument was connected, where the time mark is the nearest to a prescribed reference time mark without being after the prescribed reference time mark; an alert event acquiring portion for acquiring, from an alert event history storing portion for storing alert event information regarding alert events produced by the instruments, alert event information for which there has been notification from the instrument during an interval from the applicable installation time mark, acquired by the installation time mark acquiring portion, up until the reference time mark; a display format determining portion for determining a display format of an indicator based on the alert event information acquired by the alert event acquiring portion; and a displaying portion for displaying, on a screen, the indicator in the display format determined by the display format determining portion.

The instrument status displaying method for displaying on a screen, in a tree format, respective indicators corresponding to a plurality of instruments controlled in a hierarchical structure, includes: an installation time mark acquiring step for acquiring, as an applicable installation time mark, from an installation/removal event history storing portion for storing installation/removal event information pertaining to installation/removal of events that occur when an instrument is connected to or disconnected from a system, a time mark for when the instrument was connected, where the time mark is the nearest to a prescribed reference time mark without being after the prescribed reference time mark; an alert event acquiring step for acquiring, from an alert event history storing portion for storing alert event information regarding alert events produced by the instruments, alert event information for which there has been notification from the instrument during an interval from the applicable installation time mark, acquired in the installation time mark acquiring step, up until the reference time mark; a display format determining step for determining a display format of an indicator based on the alert event information acquired in the alert event acquiring step; and a displaying step for displaying, on a screen, the indicator in the display format determined in the display format determining step.

The use of these structures makes it possible to acquire as an applicable installation time mark, the most recent installation time mark of the installation time marks wherein connections have been made at or prior to a reference time mark, and to acquire alert information for which notification was made in the time interval from the applicable time mark up until the reference time mark. Doing so makes it possible to acquire alert information produced during the time interval wherein the instrument was disconnected, included with the alert information for which there has been notification after the instrument is connected. Moreover, this enables a display format for an indicator corresponding to an instrument to be determined based on the alert information that has been acquired, making it possible to display, on a screen, an indicator corresponding to the instrument in the display format that has been determined for that indicator. Doing so makes it possible to ascertain easily the alert statuses that have been produced during the interval wherein the instrument has been disconnected, by checking the display format of the indicator that is displayed on the screen.

The aforementioned installation/removal event information may include, at least, instrument identifying information that specifies the instrument uniquely, installation/removal identifying information that indicates whether the instrument is connected or disconnected, and an installation/removal event time mark for the time at which the instrument was connected or disconnected, where the installation time mark acquiring portion may reference, in the installation/removal event information, the installation/removal event time mark of the installation/removal event information that stores information indicating a connection of the instrument in the installation/removal identifying information, to acquire the applicable installation time mark.

The alert event information may include, at least, the instrument identifying information, category information indicating the category of alert produced by the instrument, and an alert event time mark for the time at which an alert was produced by the instrument and an alert notification time mark for the time at which there was a notification of the alert produced by the instrument, where the alert event acquiring portion may reference the alert notification time mark of the alert event notification to acquire the alert information.

The alert event information may further include priority level information indicating the priority level of an alert produced by the instrument, and the display format determining portion may reference the priority level information of the alert event information, acquired by the alert event acquiring portion, to use a display format corresponding to the highest priority level of the priority levels stored in the priority level information.

Doing so makes it possible to display, for each instrument, an indicator corresponding to the alert with the highest priority level, of those alerts that have been produced by the instrument.

The display format determining portion, when the instrument that is subject to display has an instrument hierarchically therebelow, may reference the priority level information corresponding to the instrument that is subject to display and corresponding to all of the instruments located hierarchically therebelow, as priority level information in the alert event information acquired by the alert event acquiring portion, and use the display format corresponding to the highest priority level of the priority levels that are stored in the priority level information.

Doing so makes it possible to display, as the indicator for that instrument, an indicator corresponding to an alert with the highest priority level, of all of those alerts produced by that instrument and the instruments hierarchically therebelow.

The alert event information may further include acknowledged/unacknowledged information indicating whether or not an alert produced for an instrument has been acknowledged, and the display format determining portion may reference the acknowledged/unacknowledged information of the alert event information, acquired by the alert event acquiring portion, to use a display format indicating that an event has not yet been acknowledged when information indicating "unacknowledged" is stored for any of them.

Doing so makes it possible to display an indicator using a display format that indicates that there is an unacknowledged alert when there exists even one alert, of those alerts that have been produced for the instrument, that has not yet been acknowledged.

The display format determining portion, when the instrument that is subject to display has an instrument hierarchically therebelow, may reference the acknowledged/unacknowledged information corresponding to the instrument that is subject to display and corresponding to all of the instruments located hierarchically therebelow, as acknowledged/unacknowledged information in the alert event information acquired by the alert event acquiring portion, and use the display format indicating that there is an alert event that is yet to be acknowledged if there is, for any of them, information indicating that there is an alert event that is yet to be acknowledged.

Doing so makes it possible to display an indicator for the given instrument using a display format that indicates that there is an unacknowledged alert when there exists even one alert, of those alerts that have been produced for the instrument or any of the instruments hierarchically thereunder, that has not yet been acknowledged.

The examples of the present invention make it possible to provide an instrument status displaying device and instrument status displaying method able to display statuses from intervals over which instruments have been cut off from the system.

BRIEF DESCRIPTIONS OF THE DRAWINGS

FIG. 2 is a diagram illustrating a data structure for the installation/removal event history database shown in FIG. 1.

FIG. 3 is a diagram illustrating a data structure for the alert event history database shown in FIG. 1.

FIG. 4 is a diagram illustrating a data structure for the instrument information database shown in FIG. 1.

FIG. 5 (A) is a diagram illustrating icons indicating that an instrument is connected, and FIG. 5 (B) is a diagram illustrating icons indicating that an instrument is disconnected.

FIG. 6 is a diagram illustrating icons registered corresponding to priority levels.

DETAILED DESCRIPTION

Examples of the present invention are explained below in reference to the drawings. However, the example explained below is no more than an illustration, and does not exclude various modifications and applications to technologies not explicated below. That is, examples of the present invention can be embodied in a variety of modified forms, in the scope that does not deviate from the spirit and intent thereof.

Figure 1:
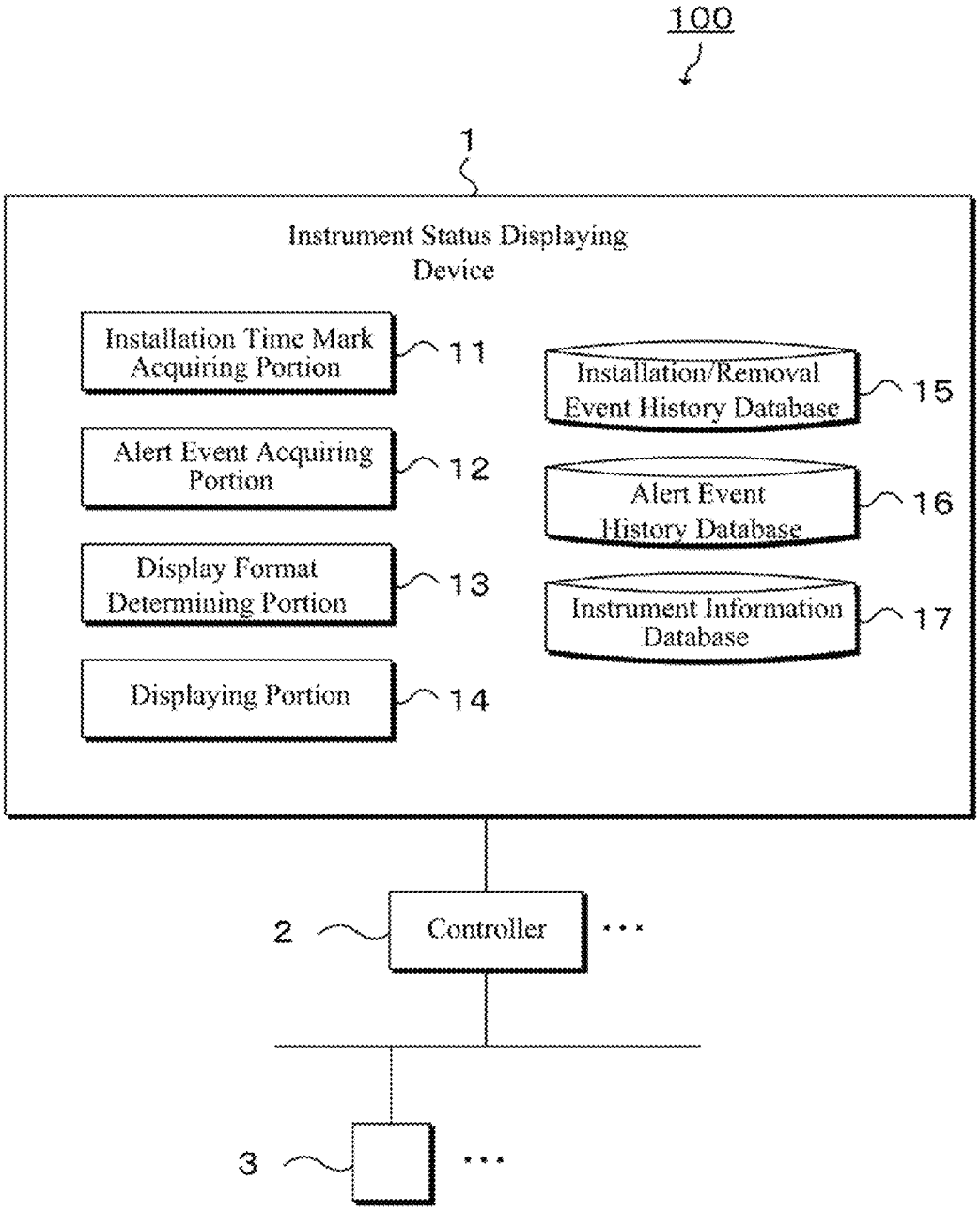
FIG. 1 is a diagram illustrating a structure for an instrument control system including an instrument status displaying device according to an example.

FIG. 1 is a diagram illustrating a schematic structure for an instrument controlling system that includes an instrument status displaying device according to an example of the present invention. As illustrated in FIG. 1, the instrument controlling system 100 comprises an instrument status displaying device 1, a controller 2, and a device 3. The controller 2 and the device 3 are "instruments" in a hierarchical relationship, where the controller 2 is located on a higher hierarchical level and the device 3 is located hierarchically below the controller 2.

The device 3 is an instrument that is disposed within a plant, and has a function for two-way communication with the controller 2 through, for example, a fieldbus. A "fieldbus" is a network with a communication protocol enabling two-way communication through digital signals, where the communication specifications have been standardized as the "Foundation Fieldbus" by the Fieldbus Foundation®.

The device 3 may be one of a variety of sensor instruments for detecting, for example, flow rates, pressures, temperatures, or the like, or one of a variety of actuators for operating a fan, a pump, or a valve positioner for controlling any of a variety of valves such as a flow rate controlling valve, a pressure controlling valve, or the like.

The controller 2 is an instrument for the overall control of the device 3 that is positioned hierarchically thereunder. The controller 2 controls the valve positioner based on, for example, a measured value for a flow rate or pressure, from the sensor instrument, to adjust the degree of opening, or the like, of a valve that is disposed within a pipe.

The instrument status displaying device 1 is a device for displaying, on a tree-format control screen, indicators corresponding to controllers 2 and devices 3 that are controlled in a hierarchical structure. The indicators comprise individual icons or pluralities of icons, as marks indicating the statuses of the instruments. The instrument status displaying device 1 physically comprises, for example, a controlling device (not shown) such as, for example, a CPU (Central Processing Unit), a storage device (not shown) such as a memory or an HDD (Hard Disk Drive), an inputting device (not shown), and a displaying device (not shown). The storage device stores an installation/removal event history database 15, an alert event history database 16, and an instrument information database 17.

The installation/removal event history database 15 is a storing portion for storing installation/removal event information pertaining to installation/removal events that occur when a controller 2 or a device 3 is connected or disconnected. The data structure of the installation/removal event history database 15 will be explained in reference to FIG. 2. The installation/removal event history database 15 has, as data fields, an installation/removal event time mark field, an installation/removal flag field, and an instrument identifying information field, for example. The installation/removal event time mark field stores installation/removal event time marks that are time marks marking the times when a controller 2 or a device 3 is connected or disconnected. The installation/removal flag field stores installation/removal flag information that is flag information (identifying information) indicating either connected or disconnected. In FIG. 2, "Installed" is stored as flag information indicating that an instrument is connected, and "Removed" is stored as flag information indicating disconnection. The instrument identifying information field stores instrument identifying information that is identifying information that uniquely specifies a controller 2 or device 3.

In the instrument controlling system 100, higher-level instruments collect communication status information regarding lower-level instruments. The communication status information is information pertaining to the status of communication of the instruments, including data communication okay/fault information. The higher-level instrument, based on the data communication okay/fault information that is included in the collected communication status information, evaluates the connection status of the lower-level instrument, to generate installation/removal event information and send it to the instrument status displaying device 1.

Here if the higher-level instrument is disconnected, then installation/removal event information wherein the installation/removal flag field stores "Removed" can be produced as installation/removal event information corresponding to that instrument and to all instruments located hierarchically thereunder, which is stored in the information/removal event history database 15. On the other hand if the higher-level instrument is connected, then installation/removal event information wherein the installation/removal flag field stores "Installed" can be produced as installation/removal event information corresponding to that instrument and to all instruments located hierarchically thereunder which is stored in the information/removal event history database 15.

The alert event history database 16 is a storing portion for storing alert event information pertaining to alert events produced by controllers 2 and devices 3. The data structure of the alert event history database 16 is explained in reference to FIG. 3. The alert event history database 16 has, as data fields, an alert event time mark field, an alert notification time mark field, an alert category field, a priority level field, an acknowledgment flag field, and an instrument identifying information field, for example.

The alert event time mark field stores an alert event time mark that is a time mark for when an alert was produced by a controller 2 or a device 3. The alert notification time mark field stores an alert notification time mark that is a time mark for when there was a notification of an alert produced by a controller 2 or a device 3. The provision of the alert notification time mark in addition to the alert event time mark is in consideration of a controller 2 or a device 3 being cut off from the system. If the controller 2 or the device 3 is cut off from the system, then it is not possible to provide notification even when an alert is produced, so the notification of the alert having been produced during the time wherein the instrument is cut off from the system can be after reconnection to the system. Given this, the provision of the alert notification time mark in addition to the alert event time mark is to enable control of alerts that are produced while an instrument is cut off from the system.

The alert category field stores alert category information that is information indicating the category of an alert that has been produced by the controller 2 or the device 3. As alert category information there is, for example, "Fault," "Adjustment in the Process," "Outside of Operating Parameters," "Requires Maintenance," "Information," "Other Alert," "Normal," and the like.

The priority level field stores priority level information that is information that indicates the priority level of an alert that is produced by a controller 2 or a device 3. The acknowledgment flag field stores acknowledgment flag information that is flag information indicating whether or not an alert produced by a controller 2 or a device 3 has been acknowledged. In FIG. 3, "No" is stored as the flag information indicating that the alert has not yet been acknowledged, and "Yes" is stored as flag information indicating that the alert has been acknowledged. The instrument identifying information field stores instrument identifying information that is identifying information that uniquely specifies a controller 2 or device 3.

The instrument information database 17 is a storing portion for storing instrument information regarding the controllers 2 and the devices 3. The data structure of the instrument information database 17 is explained in reference to FIG. 4. The instrument information database 17 has, as data fields, an instrument identifying information field and a hierarchy information field, for example. The instrument identifying information field stores instrument identifying information that is identifying information that uniquely specifies a controller 2 or device 3.

The hierarchy information field further includes a parent identifying information field and a child identifying information field. The parent identifying information field stores instrument identifying information for a parent node and the child identifying information field stores instrument identifying information for any child nodes. The existence of a parent node or a child node can be ascertained through referencing the hierarchy information fields.

As illustrated in FIG. 1, the instrument status displaying device 1 functionally has, for example, an installation time mark acquiring portion 11, an alert event acquiring portion 12, a display format determining portion 13, and a displaying portion 14.

The installation time mark acquiring portion 11 acquires, from the installation/removal event history database 15, the time mark, of those time marks wherein a controller 2 or a device 3 has been connected to the system, that is closest to a prescribed reference time mark but no later than the prescribed reference time mark, as an applicable installation time mark that is subject to processing. This is explained in detail below.

The installation time mark acquiring portion 11 references the installation/removal event history database 15, to extract installation/removal event information wherein instrument identifying information corresponding to the instrument that is subject to processing is stored in the instrument identifying information field, flag information that indicates the connection is stored in the installation/removal the field, and the installation/removal event time mark that is nearest to the reference time mark but no later than the reference time mark is stored in the installation event time mark field. The installation time mark acquiring portion 11 acquires, as the applicable installation time mark, the installation/removal event time mark stored in the installation/removal event time mark field for the extracted installation/removal event information.

The aforementioned reference time mark can be set arbitrarily, or can be set to the current time. If the reference time mark is set to the current time, then the installation/removal event information wherein the flag information that indicates the connection is stored in the installation/removal flag field and the most recent time is stored in the installation/removal event time mark field may be extracted from the installation/removal event history database 15.

The installation time mark acquiring portion 11, prior to acquiring the applicable installation time mark, references the installation/removal event history database 15 to evaluate whether or not the instrument that is subject to processing was connected at the reference time mark, and if connected, acquires the applicable installation time mark. Specifically, the installation time mark acquiring portion 11 references the installation/removal event information corresponding to the instrument that is subject to processing, and if flag information indicating a connection is stored in the installation/removal flag field at the reference time mark, acquires the applicable installation time mark.

The alert event acquiring portion 12 acquires, from the alert event history database 16, the alert event information for which there was notification from a controller 2 or a device 3 during the time interval between the applicable installation time mark, acquired by the installation time mark acquiring portion 11, and the reference time mark.

Specifically, the alert event acquiring portion 12 extracts, from the alert event history database 16, alert event information corresponding to the instrument that is subject to processing, information wherein the alert notification time mark, that is stored in the alert notification time mark field, is a time mark between the applicable installation time mark and the reference time mark.

The display format determining portion 13 determines the display format for an indicator corresponding to the instrument that is subject to processing. The display format determining portion 13 determines the display format for the indicator corresponding to the instrument that is subject to processing, through a combination of display formats of icons that can be used depending on whether or not the instrument is connected, the priority level, and the state of acknowledgment, as explained in (1) through (3), below.

(1) Whether or not the Instrument is Connected

The display format determining portion 13, when it has been concluded by the installation time mark acquiring portion 11 that an instrument that is subject to processing is connected, uses, as the display format for the indicator corresponding to the instrument that is subject to processing, a format wherein an icon indicating that the instrument that is subject to processing is connected is displayed. An icon showing the respective instrument schematically may be used as the icon that indicates that instrument is connected. FIG. 5 (A) shows examples of icons I1 and I2 indicating that instruments are connected.

The display format determining portion 13, when it has been concluded by the installation time mark acquiring portion 11 that an instrument that is subject to processing is not connected, uses, as the display format for the indicator corresponding to the instrument that is subject to processing, a format wherein an icon indicating that the instrument that is subject to processing is not connected is displayed. An icon showing schematically a disconnected state may be used as the icon that indicates that instrument is disconnected, and the icon may be displayed superimposed on the icon showing the connected state. FIG. 5 (B) illustrates an icon 13 indicating disconnection, displayed by being superimposed on the icons I1 and I2 indicating that the instruments are connected.

(2) Priority Level

The display format determining portion 13 uses, as the display format for the indicator corresponding to the instrument that is subject to processing, a format wherein an icon corresponding to the highest priority level of those priority levels that are stored in the priority level field for the alert event information acquired by the alert event acquiring portion 12 is displayed. Doing so makes it possible to display, for each instrument, an indicator corresponding to the alert with the highest priority level, of all those alerts that have been produced by the respective instruments.

The aforementioned priority levels can be established in seven levels from "1" through "7" corresponding to the seven alert categories from, for example, "Fault," "Adjustment in the Process," "Outside of Operating Parameters," "Requires Maintenance," "Information," "Other Alert," and "Normal." In this case, the priority level "1" is the highest priority level, and the priority level "7" is the lowest priority level. As illustrated in FIG. 6, icons for expressing the degrees of the priority levels, corresponding to the priority levels of "1" through "7" are stored in advance in the storage device.

The display format determining portion 13, when the instrument that is subject to processing has an instrument that is hierarchically thereunder, references not only the alert event information for the instrument that is subject to processing, but also the alert event information for the instruments located hierarchically therebelow. The display format determining portion 13 identifies the highest priority level from those alert event information, and then uses, as the display format for the indicator corresponding to the instrument that is subject to processing, a format wherein an icon corresponding to the identified priority level is displayed. Doing so makes it possible to display, as an indicator for that instrument, an icon corresponding to the alert with the highest priority level of all of the alerts produced by that instrument and the instruments hierarchically thereunder.

Whether or not the instrument that is subject to processing has an instrument that is hierarchically thereunder is evaluated as described below. The display format determining portion 13 references the instrument information database 17 to evaluate whether or not instrument identifying information is stored in the child identifying information field in the instrument information corresponding to the instrument that is subject to processing. If instrument identifying information is stored in the child identifying information field, then the display format determining portion 13 concludes that there is an instrument that is hierarchically therebelow.

Figure 7:
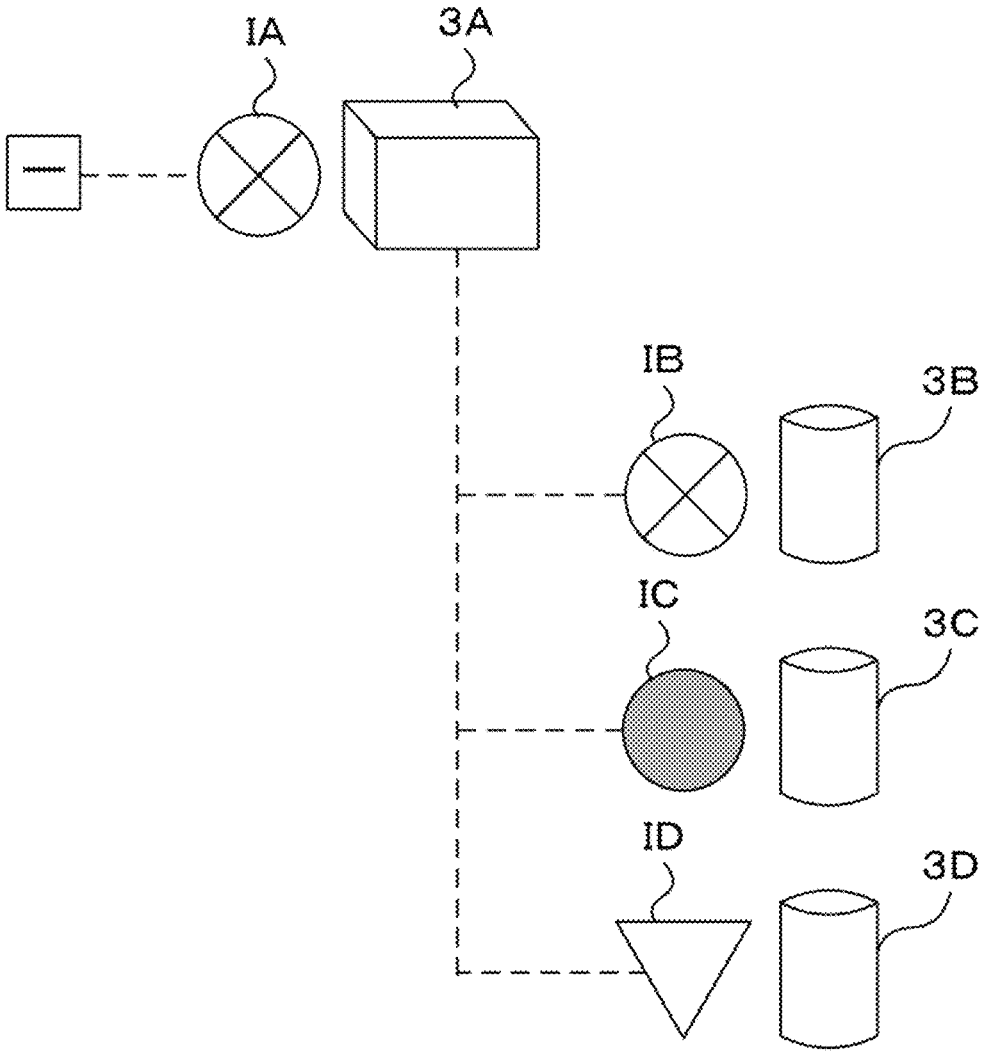
FIG. 7 is a diagram showing a tree format in a state wherein three instruments are located on a lower hierarchical level under an instrument located on a higher hierarchical level.

A case wherein a priority level display of an instrument on a higher hierarchical level is replaced by the priority level display of an instrument on a lower hierarchical level is explained referencing FIG. 7. FIG. 7 is a diagram showing a tree format in a state wherein three instruments are located on a lower hierarchical level under an instrument located on a higher hierarchical level. The indicator display area for the three instruments located on the lower hierarchical level displays icons 3B, 3C, and 3D that indicate that the respective instruments are connected, and icons IB, IC, and ID that indicate the highest priority levels in the respective instruments. In this case, the highest of the priority levels from among the three icons a IB, IC, and ID is the icon IB corresponding to the "1" that is the highest priority level. (See FIG. 6.) Here the highest priority level for the instrument located on the higher hierarchical level is "7 (Normal)." In this case, that which is displayed in the indicator display area for the instrument that is located on the higher priority level is not the icon for Normal, corresponding to the priority level of "7," but rather the icon IA that is the same as the icon IB that corresponds to the highest priority level of "1."

(3) Unacknowledged Status

The display format determining portion 13 references the acknowledgment flag field of the alert event information, and if there is even one that stores flag information indicating that an alert is unacknowledged, uses, as the display format for the indicator corresponding to the instrument that is subject to processing, a format wherein the icon is displayed blinking Doing so makes it possible to display an indicator through a blinking display of an icon to show that, of the alerts that have been produced by the instrument that is subject to processing, there is at least one alert that is yet to be acknowledged.

The display format determining portion 13, when there is an instrument that is hierarchically below the instrument that is subject to processing, references not only the alert event information for the instrument that is subject to processing, but includes also alert event information for the instruments that are located hierarchically thereunder. When flag information indicating that there is an unacknowledged alert is stored in the acknowledgment flag information of any of these alert event information, the display format determining portion 13 uses a format wherein the icon is displayed blinking as the display format for the indicator corresponding to the instrument that is subject to processing. Doing so makes it possible to display the indicator for the instrument that is subject to processing using a blinking display of the icon, indicating that there is an alert that has not yet been acknowledged, if, among the alerts that have been produced by the instrument subject to processing, or by any instrument hierarchically thereunder, there is at least one alert that has not yet been acknowledged.

Note that the display format for an indicator to display the unacknowledged status is not limited to a blinking icon. For example, an icon that indicates that there is an alert that has not been acknowledged may be displayed instead.

The displaying portion 14 shown in FIG. 1 displays, on a control screen, the indicator corresponding to the instrument that is subject to processing, using the display format for the indicator that has been determined by the display format determining portion 13.

Figure 8:
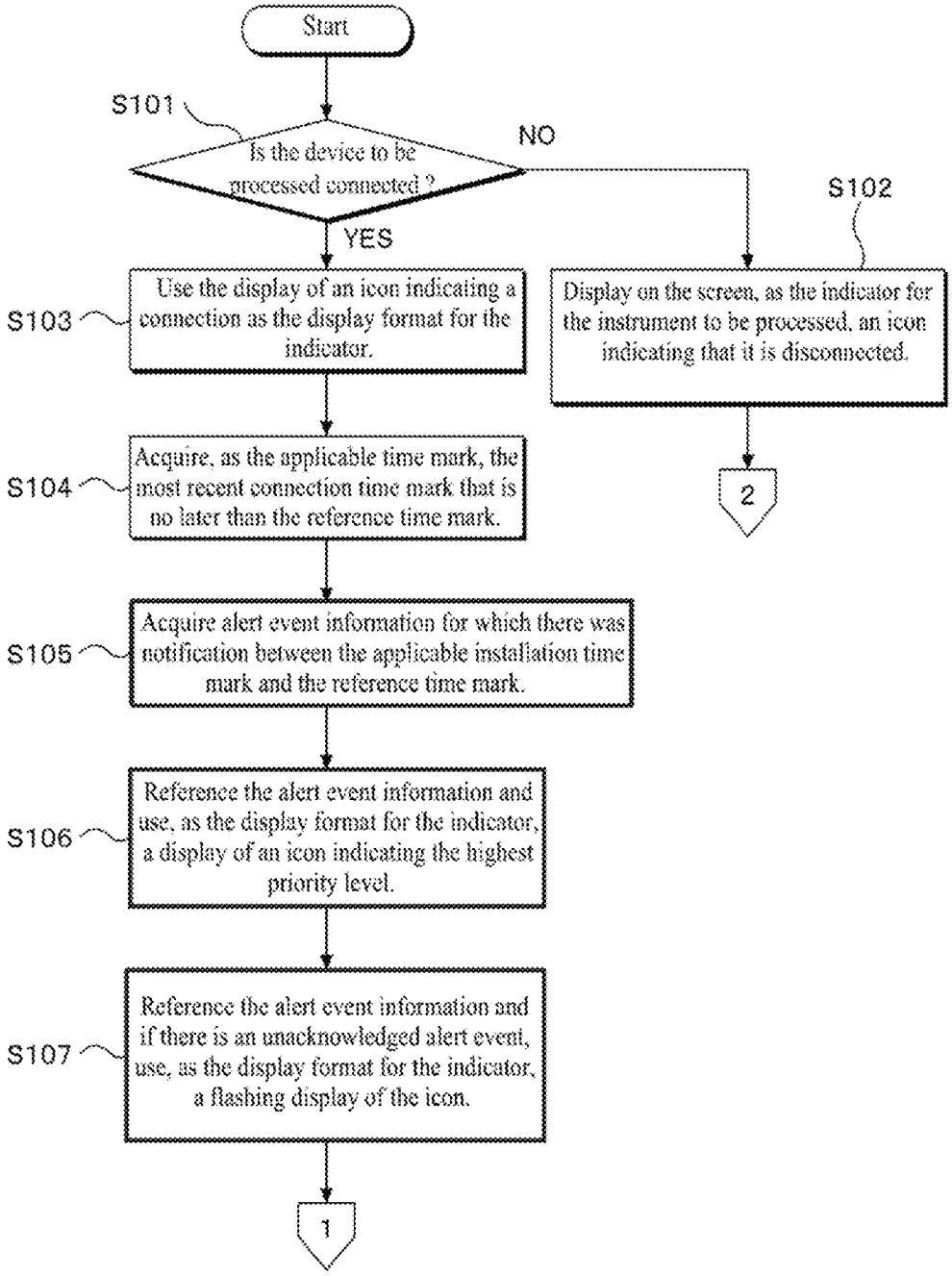
FIG. 8 is a flowchart for explaining the operation of an instrument status displaying device according to an example.
Figure 9:
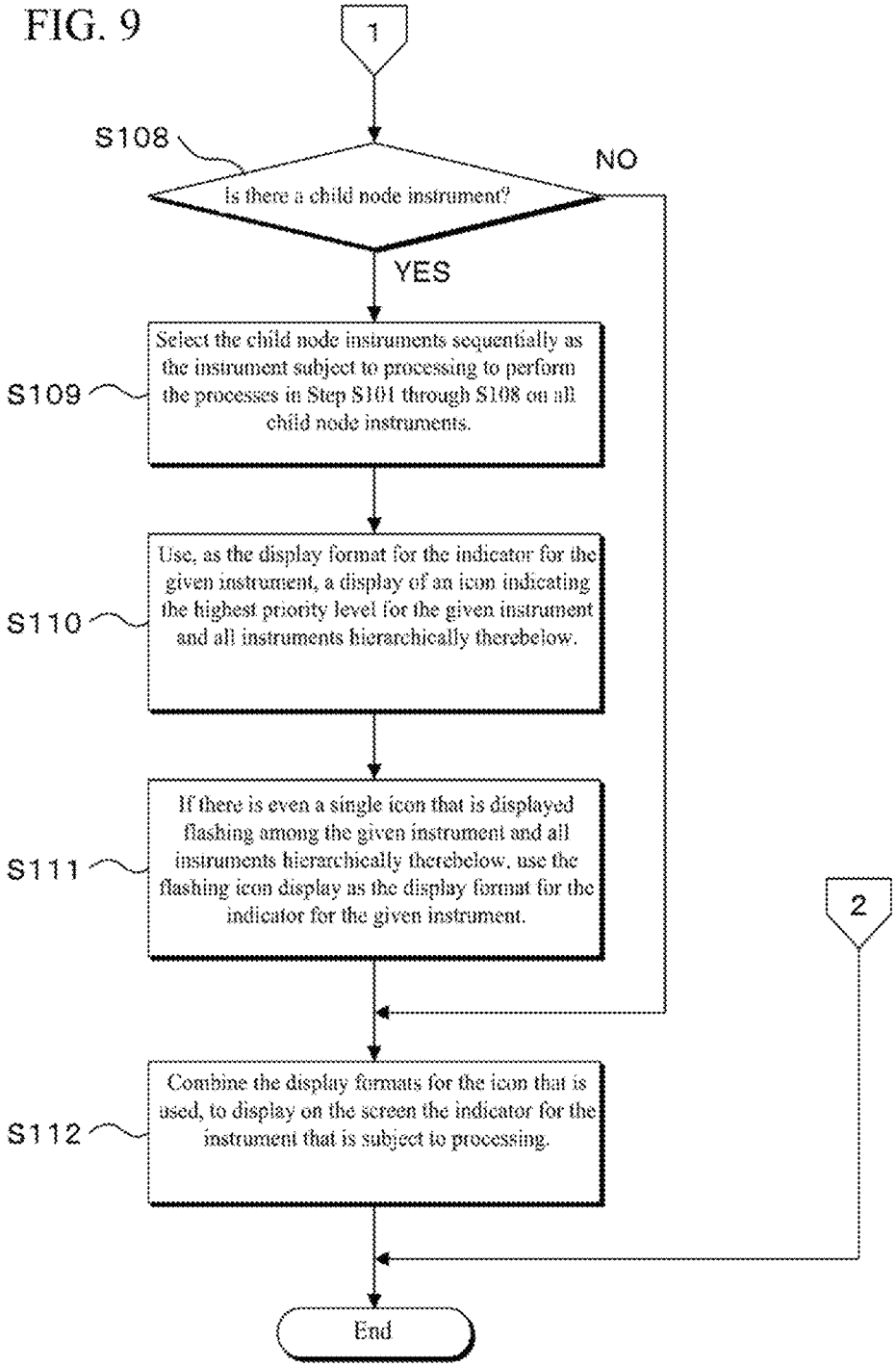
FIG. 9 is a flowchart for explaining the operation of an instrument status displaying device according to the example.

The operation of the instrument status displaying device 1 in the present example is explained next in reference to FIG. 8 and FIG. 9. In this operation, the processes described below are started by selecting, as an instrument that is subject to processing, an instrument that is located on the highest hierarchical level of the controllers 2 and devices 3 that are displayed in a tree format on the control screen.

First, the installation time mark acquiring portion 11 references the installation event history database 15 to evaluate whether or not the instrument subject to processing is connected (Step S101). If the conclusion is NO (Step S101: NO), then the display format determining portion 13 uses a format wherein an icon indicating disconnection is displayed as the display format for the indicator for the instrument that is subject to processing, and the displaying portion 14 displays an icon indicating disconnection on the screen as the indicator for the instrument subject to processing (Step S102). After this, processing returns to the main routine.

On the other hand, if the conclusion in the evaluation in Step S101, above, is that the instrument subject to processing is connected (Step S101: YES), then the display format determining portion 13 uses a format wherein an icon indicating that the instrument is connected is displayed as the display format for the indicator for the instrument that is subject to processing (Step S103).

Following this, the alert event acquiring portion 12 acquires, from the alert event history database 16, the alert event information for which notification was provided by the instrument subject to processing between the applicable installation time mark, acquired in Step S104, and the reference time mark (Step S105).

Following this, the display format determining portion 13 references the priority field of the alert event information acquired in Step S105, and uses, as the display format for the indicator for the instrument that is subject to processing, a format that displays an icon indicating the highest priority level of those various priority levels that are stored in the priority level field (Step S106).

Following this, the display format determining portion 13 references the acknowledgment flag field for the alert event information acquired in Step S105, and uses, as the display format for the indicator for the instrument subject to processing, a format wherein the icon is displayed flashing if there is any flag information stored indicating that is an alert that is yet to be acknowledged (Step S107).

Following this, the display format determining portion 13 references the instrument information database 17 to evaluate whether or not there is an instrument at a child node of the instrument that is subject to processing (Step S108). If the conclusion is NO (Step S108: NO), then the displaying portion 14 combines the icon display formats used in Step S103, Step S106, and Step S107, above, to display, on the screen, the indicator for the instrument that is subject to processing (Step S112). After this, processing returns to the main routine.

On the other hand, if the conclusion in the evaluation in Step S108, above, is that an instrument exists on a child node of the instrument that is subject to processing (Step S108: YES), then the instrument status displaying device 1 selects sequentially the instruments of the child nodes as the instruments that are subject to processing to perform, for all of the instruments of the child nodes, each of the individual processes from Step S101 through Step S108, above (Step S109).

Following this, the display format determining portion 13, for each of the instruments selected as an instrument that is subject to processing in the individual processes in Step S101 through Step S108, above, compares the priority levels corresponding to the respective icons used by the given device and by all of the devices located hierarchically thereunder, and uses, as the display format for the indicator of the given instrument, the format that displays the icon that indicates the highest priority level therein (Step S110).

Following this, if, for any of the instruments selected as the instrument that is subject to processing in any of the processes from Step S101 through Step S108, above, a flashing display is used for the icon for indicating that there is an unacknowledged alert for the given instrument or for any of the instruments located hierarchically thereunder, the display format determining portion 13 uses, as the display format for the indicator for the given instrument, a format wherein the icon is displayed flashing (Step S111).

Following this, the displaying portion 14 combines the icon display formats used in Step S103, Step S106, Step S107, Step S110, and Step S111, above, to display, on the screen, an indicator for the individual instrument that is subject to processing (Step S112). Following this, the main procedure is concluded. After this, processing returns to the main routine.

As described above, the instrument status displaying device 1 in the present example, having the installation time mark acquiring portion 11 makes it possible to acquire, as an applicable installation time mark, the most recent installation time mark of the installation time marks wherein a connection has been made at or prior to a reference time mark, and having the alert event acquiring portion 12 make it possible to acquire alert information for which there was notification between the applicable installation time mark and the reference time mark. This makes it possible to acquire alert information that was produced by the controllers 2 and devices 3 while disconnected, to be included with the alert information for which there is notification after the controllers 2 and devices 3 are connected.

Moreover, the instrument status displaying device 1 in the present example having the display format determining portion 13 makes it possible to determine a display format for an indicator corresponding to a controller 2 or a device 3 based on alert information acquired by the alert event acquiring portion 12, and having the displaying portion 14 makes it possible to display, on the screen, the indicator corresponding to the controller 2 or the device 3 in the display format for the indicator that was determined by the display format determining portion 13. Doing so makes it possible to ascertain easily the status of alerts produced by the controllers 2 and the devices 3, while disconnected, by checking the displaced statuses of the indicators displayed on the screen.

Given this, the instrument status displaying device 1 according to the present form of embodiment not only makes it possible to display the statuses of the controllers 2 and devices 3 that are connected to the system, but also possible to display the statuses of the controllers 2 and devices 3 over the intervals wherein they were cut off from the system.

I claim:

1. An instrument status display displaying on a screen, in a tree format, respective indicators corresponding to a plurality of instruments controlled in a hierarchical structure, comprising:

an installation time mark acquiring portion acquiring, as an applicable installation time mark, from an installation/removal event history storing portion storing installation/removal event information pertaining to installation/removal of events that occur when an instrument is connected to or disconnected from a system, a time mark when the instrument was connected, where the time mark is the nearest to a prescribed reference time mark without being after the prescribed reference time mark;

an alert event acquiring portion acquiring, from an alert event history storing portion storing alert event information regarding alert events produced by the instruments, alert event information for which there has been notification from the instrument during an interval from the applicable installation time mark, acquired by the installation time mark acquiring portion, up until the reference time mark;

a display format determining portion determining a display format of an indicator based on the alert event information acquired by the alert event acquiring portion; and a displaying portion displaying, on a screen, the indicator in the display format determined by the display format determining portion.

2. The instrument status displaying device as set forth in claim 1, wherein:

the installation/removal event information includes, at least, instrument identifying information for specifying an instrument uniquely, installation/removal identifying information indicating that the instrument is either connected or disconnected, and an installation/removal event time mark for when the instrument was connected or disconnected; and the installation time mark acquiring portion references, in the installation/removal event information, the installation/removal event time mark of the installation/removal event information that stores information indicating the connection of the instrument in the installation/removal identifying information.

3. The instrument status displaying device as set forth in claim 1, wherein:

the alert event information includes, at least, the instrument identifying information, category information indicating a category of alert produced by the instrument, and an alert event time mark for the time at which an alert was produced by an instrument and an alert notification time mark for the time of the notification of the alert that was produced by the instrument; and the alert event acquiring portion acquires the alert information referencing the alert information time mark of the alert information.

4. The instrument status displaying device as set forth in claim 3, wherein:

the alert event information includes priority level information indicating the priority level of an alert that has been produced by an instrument; and the display format determining portion references the priority level information in the alert event information that is acquired by the alert event in acquiring portion and uses a display format corresponding to the highest priority level of the priority levels stored in the priority level information.

5. The instrument status displaying device as set forth in claim 4, wherein:

the display format determining portion uses a display format corresponding to the highest priority level of the priority levels stored in the priority level information, referencing the priority level information corresponding to the instrument that is subject to display and to all instruments located hierarchically thereunder, which is priority level information of the alert event information acquired by the alert event acquiring portion, when an instrument that is subject to display has an instrument that is hierarchically below the given instrument.

6. The instrument status displaying device as set forth in claim 3, wherein:

the alert event information further includes acknowledged/unacknowledged information indicating whether or not an alert produced by an instrument has been acknowledged; and the display format determining portion references the acknowledged/unacknowledged information of the alert event information acquired by the alert event acquiring portion and if there is any information stored indicating an alert that has not been acknowledged, uses a display format that indicates that there is an alert that has not been acknowledged.

7. The instrument status displaying device as set forth in claim 6, wherein:

the display format determining portion uses a display format that indicates that there is an alert that has not been acknowledged when there is information stored indicating that there is an alert that has not been acknowledged, referencing the acknowledged/unacknowledged information corresponding to the instrument that is subject to display and corresponding to all instruments located hierarchically under that instrument, which is acknowledged/unacknowledged information of the alert event information acquired by the alert event acquiring portion when the instrument that is subject to display has an instrument hierarchically thereunder.

8. An instrument status displaying method for displaying on a screen, in a tree format, respective indicators corresponding to a plurality of instruments controlled in a hierarchical structure, comprising the steps of:

an installation time mark acquiring step acquiring, as an applicable installation time mark, from an installation/removal event history storing portion storing installation/removal event information pertaining to installation/removal of events that occur when an instrument is connected to or disconnected from a system, a time mark for when the instrument was connected, where the time mark is the nearest to a prescribed reference time mark without being after the prescribed reference time mark;

an alert event acquiring step acquiring, from an alert event history storing portion storing alert event information regarding alert events produced by the instruments, alert event information for which there has been notification from the instrument during an interval from the applicable installation time mark, acquired in the installation time mark acquiring step, up until the reference time mark;

a display format determining step determining a display format of an indicator based on the alert event information acquired in the alert event acquiring step; and a displaying step displaying, on a screen, the indicator in the display format determined in the display format determining step.

* * * * *